United States Patent [19]

Bell et al.

[11] 4,400,911

[45] Aug. 30, 1983

[54] ADJUSTING WINDOW SECURITY GRILL

[75] Inventors: Dwain C. Bell; Aurel L. Bell, both of Minneapolis, Minn.

[73] Assignee: Bell Manufacturing & Services, Inc., Minneapolis, Minn.

[21] Appl. No.: 194,685

[22] Filed: Oct. 6, 1980

[51] Int. Cl.[3] ..... E06B 3/68

[52] U.S. Cl. ..... 49/55; 49/57; 52/669

[58] Field of Search ..... 52/663, 664, 665, 669; 49/50, 55, 57

[56] References Cited

U.S. PATENT DOCUMENTS

| | | | |
|---|---|---|---|
| 232,760 | 9/1880 | Robertson | 52/669 |
| 2,101,707 | 12/1937 | Ewing | 52/669 X |
| 2,176,334 | 10/1939 | Gibson | 52/665 X |
| 4,038,800 | 8/1977 | Daley, Jr. | 49/55 X |
| 4,162,590 | 7/1979 | Earley | 49/55 |

*Primary Examiner*—Kenneth Downey

*Attorney, Agent, or Firm*—Orrin M. Haugen; Thomas J. Nikolai

[57] ABSTRACT

A security grill which may be placed within a window frame to prevent break ins. In one arrangement, the grill comprises a first channel member adapted to be affixed to the window sill and a second channel member adapted to be secured to the upper window frame. Fixedly attached to the second channel member at predetermined spaced apart locations therealong are tubular stubs of a predetermined length. The bottom channel member has a pattern of apertures extending through the top wall thereof with a spacing between apertures corresponding to the longitudinal spacing between the stubs on the upper channel member. Fitted into the apertures in the second channel member are a plurality of bars which extend outwardly therefrom so as to be insertable within the stubs on the first or upper channel member. Because of the telescoping relationship of the bars within the tubular stubs, a degree of vertical adjustment between the channel members can be obtained so as to accommodate installation in a variety of window sizes. In an alternative embodiment, a plurality of generally horizontal channels are provided and on each such channel a plurality of tubular stubs are welded or otherwise affixed at spaced apart intervals. The tubular stubs are arranged to receive elongated vertical bars which may be held in place during installation by means of set screws or the like. The horizontal channels may then be attached at each end to the sides of the window frame to be secured against unauthorized entry.

6 Claims, 4 Drawing Figures

ADJUSTING WINDOW SECURITY GRILL

BACKGROUND OF THE INVENTION

I. Field of the Invention

This invention relates generally to a security grill which may be mounted in the window of a building so as to preclude forced entry and more particularly to a security grill which provides an adjustability feature to facilitate installation.

II. Discussion of the Prior Art

Barred windows have long been used to prevent unauthorized entry into a building. Because of variations in the size of window openings, it has been necessary in the past to custom make the grill to rather exacting measurements and then subsequently install the grill, as a unit, in the window. The custom designing necessarily increases the cost of manufacture and also creates problems at the time of installation if accurate measurements were not taken in the first instance. The present invention obviates both of the aforementioned disadvantages of custom designed security grills.

SUMMARY OF THE INVENTION

In accordance with the teachings of one form of the present invention, there is provided a window security grill which is, within limits, adjustable to fit a variety of window sizes. Specifically, first and second channel members are provided, the channel members being adapted to be secured to the bottom window sill and the opposite or upper horizontally extending window frame member. The upper channel member has a plurality of tubular studs affixed to and projecting outwardly from the bottom of the channel member, the spacing between the stubs being sufficiently close to preclude entry of an intruder once the assembly is mounted in place with respect to a building's window opening. The bottom channel member which is arranged to be secured to the window sill is provided with a pattern of apertures at longitudinal spacing corresponding to the center-to-center spacing of the tubular stubs affixed to the upper channel member. These spaced apertures are adapted to receive the ends of a corresponding number of rigid bars of a predetermined length, the bars having an outer dimension so as to be telescopically received within the ends of the tubular stubs. Because of the telescoping relationship, the vertical spacing between the upper and lower channel members is adjustable to permit the grill to be secured in place in window openings of differing sizes. As such, during manufacture the bars may be cut in standard lengths, and, upon installation, variations in the height of the window openings can be accommodated.

In an alternative embodiment which is designed to accommodate windows of varying heights, a plurality of generally horizontal chanels are provided and on each channel are a predetermined number of spaced apart tubular stubs oriented transversely to the length dimension of the channels. Passing through aligned tubular stubs on the plurality of horizontal channels are vertically oriented bars. Set screws may conveniently be used to hold the horizontal channels in a desired position along the length dimension of the veritical bars as the grill assembly is being installed on the building. Attachment is made by securing the opposite ends of the horizontal channels to the window frame or the sides of the building defining the window opening.

OBJECTS

It is accordingly the principal object of the present invention to provide a new and improved security grill for preventing unauthorized entry into a building.

Another object of the invention is to provide in the design of a window grill features whereby original manufacture and subsequent installation are simplified.

Still another object of the invention is to provide a vertically adjustable security grill for mounting in a building's window opening.

These and other objects and advantages of the invention will become apparent to those skilled in the art from the following detailed description of a preferred embodiment considered in conjuncation with the accompanying drawings.

DESCRIPTION OF THE PREFERRED EMBODIMENT

Figure 2:
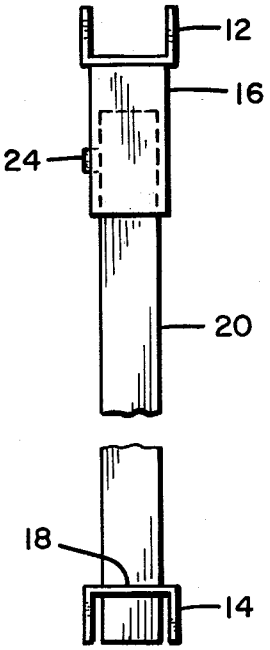
FIG. 2 is an end view of the assembly of FIG. 1.
Figure 1:
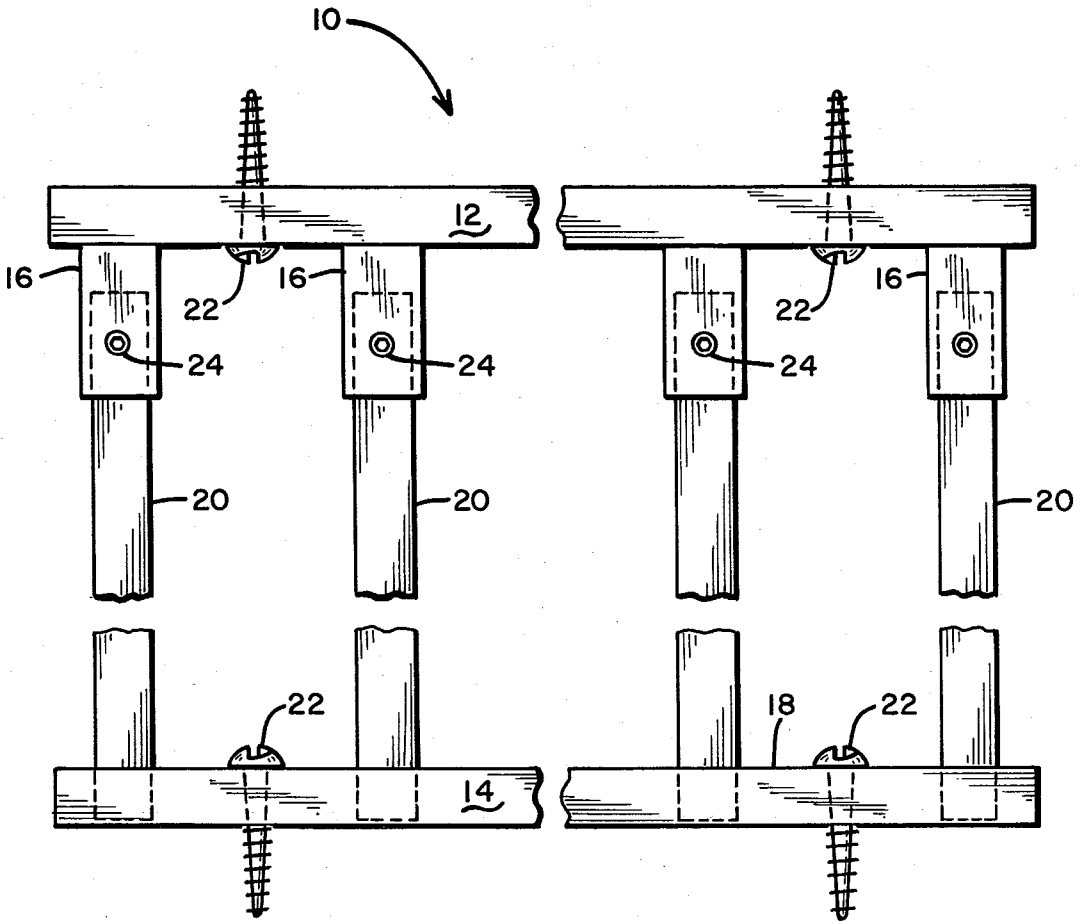
FIG. 1 is a front view of the adjustable security grill in one embodiment of the present invention.

Referring first to FIG. 1, numeral 10 indicates generally a security grill made in accordance with the teachings of the present invention. As can be seen, it comprises a pair of elongated channel members 12 and 14 which are preferably fabricated from iron or steel and may, for example, be one inch in width and one-half inch high. The overall length of the channel members 12 and 14 is determined by the length dimension of the window opening in which the grill is to be installed.

Affixed to the bottom surface of the upper channel member 12 are a plurality of tubular stubs 16. The stubs may be formed from tubular steel and may be either rectangular or circular in cross-section. Without limitation, the stubs 16 may have a length in the range of from 3 to 8 inches, 5 inches having been found to be suitable for most installations.

The center-to-center spacing between adjacent stubs in such that an intruder may not fit between them. If desired, of course, it is possible to provide a sufficiently close spacing between adjacent studs so that not even an intruder's arm could pass between.

The lower channel member 14 may also be formed from iron or steel. Formed in the upper horizontal surface 18 of the channel 14 are a plurality of apertures whose center-to-center spacing corresponds to the center-to-center spacing of the stubs 16 projecting downwardly from the upper channel member 12. These apertures are of a dimension to slidingly receive the lower end portions of a plurality of bars 20. The bars may be either rectangular or circular in cross-section depending upon the type of tubular stub 16 employed.

The length of the bars 20 is chosen so as to be generally less than the spacing between the window sill and the upper horizontal window frame member of the opening in which the grill is to be installed. The upper ends of the bars 20 are arranged to be inserted into the tubular stubs 16 such that telescoping length adjustment may be accomplished whereby the lower channel member 14 may be secured to the window sill as by screws 22 and the upper channel member may likewise be secured to the upper window frame. Sufficient overlap exists between the upper ends of the bars 20 and the stubs 16 so that when the upper channel 12 is affixed in place, the bars 20 cannot be removed.

Because during installation the bars 20 are loosely fitted within the apertures of the lower channel 14, it has been found expedient to provide set screws as at 24 which are inserted into threaded apertures formed through the side walls of the stubs 16, thereby maintaining the desired spacing between the horizontal channels 12 and 14 as the upper channel member 12 is being secured in place to the upper window frame member (not shown).

Figure 3:
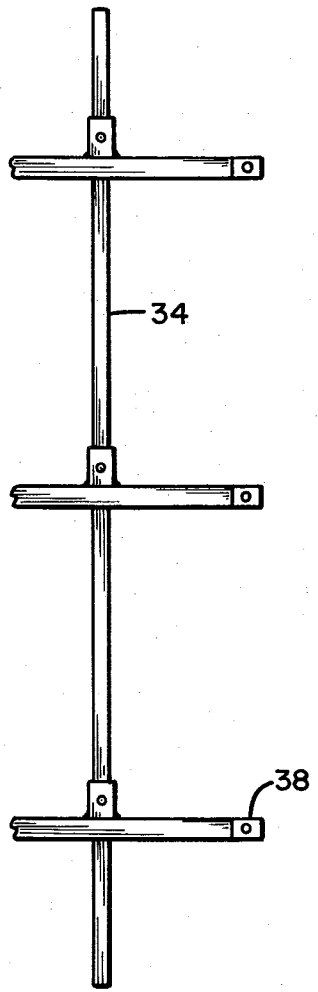
FIG. 3 is a front view of an alternative embodiment.
Figure 3:
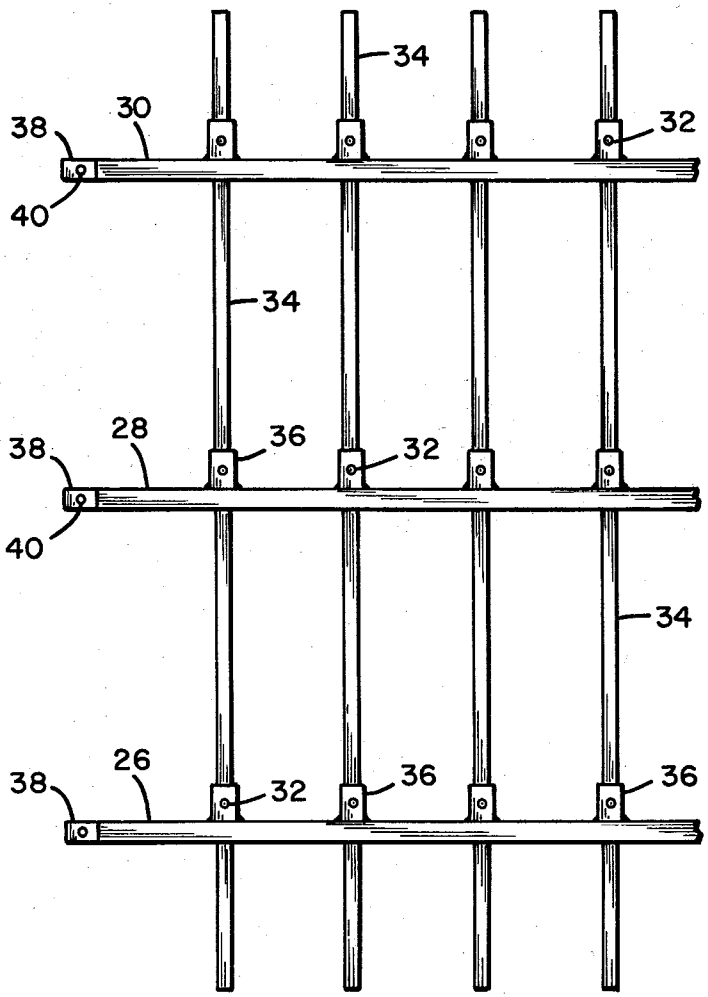

In FIG. 3 there is illustrated an alternative embodiment which is found useful for securing windows having a substantial vertical dimension. Here, a plurality of horizontal channels 26, 28, 30, etc are provided and each includes a plurality of tubular studs as at 32 attached to the side surface thereof as by welding or other suitable means. The spacings between adjacent tubular stubs on the horizontal channels 26, 28 and 30 are generally equal so as to accommodate vertical bars as at 34. The bars 34 may be either round or square in cross-section but are of an outer dimension which permits them to fit through the tubular studs 32 as indicated in the drawings.

The positioning of the horizontal channels 26, 28 and 30 along the length dimension of the bars 34 is adjustable but to hold the members rigidly intact at the time of installation, it has been found convenient to form threaded holes through the side walls of the tubular studs 32 for receiving set screws as at 36. Where desired, the set screws may be countersunk within the tubular studs 32 and the ends thereof covered with apoxy to prevent a potential intruder from removing the set screws and then removing the vertical bars.

Figure 4:
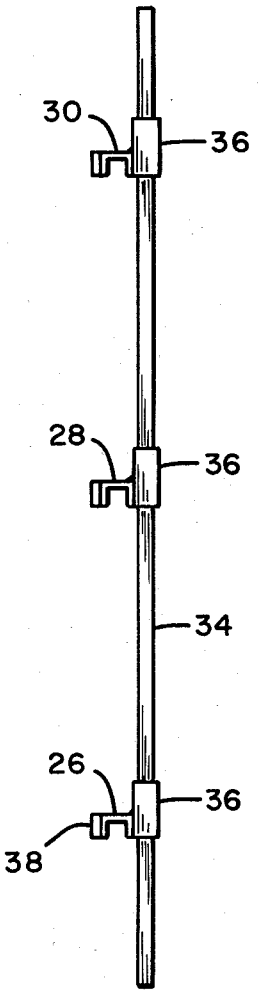
FIG. 4 is an end view of the assembly of FIG. 3.

The grill of FIGS. 3 and 4 is arranged to be affixed to the sides of the window frame or the side walls of the building defining the window opening. In this respect, apertured plates as at 38 are welded to the side wall of the horizontal channels allowing lag bolts to pass through the apertures 40 and into the framework of the building being secured. The embodiment of FIGS. 3 and 4 can be mounted outside, inside, or in the window frame itself. It offers the advantage of being assembled at the site of the installation to thereby accommodate a variety of window sizes and shapes. Also, because of the knock-down construction of the security grills of the present invention, shipping and handling problems are reduced.

While there has been shown and described preferred embodiments of the invention, others skilled in the art, upon reading the instant disclosure and reviewing the accompanying drawings, may conceive of variations which still fall within the spirit of the present invention. Hence, the true scope of the invention is to be determined from the following claims.

What is claimed is:

1. a security grill for preventing unauthorized entry into a building, comprising:

(a) a pair of elongated members adapted to be attached to opposite sides of a building's window opening, one of said pair of elongated members having a plurality of apertures formed therein at predetermined spacings;

(b) a corresponding plurality of tubular studs of a predetermined length affixed to and extending perpendicularly from the other of said pair of elongated members, the lateral spacing between adjacent stubs corresponding to said predetermined spacings; and (c) a corresponding plurality of bar members having first ends insertable into said apertures and second ends telescopingly received in said tubular stubs.

2. The security grill as in claim 1 wherein said elongated members comprise metal channels.

3. The security grill as in claim 1 wherein said tubular stubs and said bar members are of a rectangular cross-section.

4. A security grill for preventing unauthorized entry into a building comprising:

(a) a plurality of elongated members adapted to be attached to opposite sides of a building's window opening;

(b) a plurality of tubular stubs of a predetermined length affixed to and extending perpendicularly from said plurality of elongated members, the lateral spacing between adjacent stubs corresponding to predetermined spacings, the predetermined spacings being equal on each of said plurality of elongated members; and (c) a plurality of bar members insertable through aligned ones of said plurality of tubular stubs on said plurality of elongated members.

5. The security grill as in claim 4 wherein said elongated members comprise metal channels.

6. The security grill as in claim 4 wherein said tubular stubs and said bar members are of a rectangular cross-section.

* * * * *

UNITED STATES PATENT AND TRADEMARK OFFICE

CERTIFICATE OF CORRECTION

PATENT NO. : 4,400,911

DATED : August 30, 1983

INVENTOR(S) : Dwain C. Bell and Aurel L. Bell

It is certified that error appears in the above-identified patent and that said Letters Patent are hereby corrected as shown below:

Column 4, line 16, Claim 1(b), delete "studs" and put instead -- stubs --.

Signed and Sealed this

First Day of November 1983

[SEAL]

*Attest:*

GERALD J. MOSSINGHOFF

*Attesting Officer*

*Commissioner of Patents and Trademarks*